United States Patent [19]

Smith

[11] Patent Number: 4,860,395

[45] Date of Patent: Aug. 29, 1989

[54] WATER-COOLED LOUNGING PAD

[76] Inventor: Michael G. Smith, 415 Turrin Dr., Pleasant Hill, Calif. 94523

[21] Appl. No.: 198,129

[22] Filed: May 24, 1988

[51] Int. Cl.[4] ..... A47C 27/08

[52] U.S. Cl. ..... 5/420; 5/421; 5/451; 156/275.1; 156/380.6; 165/46

[58] Field of Search ..... 5/451, 452, 449, 450, 5/441, 455, 457, 458, 453, 454, 417, 418, 419, 420, 421, 422; 165/46; 441/129

[56] References Cited

U.S. PATENT DOCUMENTS

| | | | |
|---|---|---|---|
| D. 107,520 | 12/1937 | Johnson . | |
| D. 197,397 | 1/1964 | Emery et al. . | |
| D. 253,983 | 1/1980 | McRight . | |
| D. 255,854 | 7/1980 | Gay . | |
| D. 278,004 | 3/1985 | Sigona . | |
| 3,170,172 | 2/1965 | Kessman | 5/457 |
| 3,416,169 | 12/1968 | Emery | 5/441 |
| 3,838,470 | 10/1974 | May | 5/451 |
| 4,017,921 | 4/1977 | Hernandez | 5/421 |
| 4,136,412 | 1/1979 | Wilhelm | 5/455 |
| 4,459,714 | 7/1984 | Lin | 5/451 |
| 4,629,433 | 12/1986 | Magid | 441/129 |

FOREIGN PATENT DOCUMENTS

| | | | |
|---|---|---|---|
| 864314 | 12/1952 | Fed. Rep. of Germany | 5/419 |
| 1034337 | 7/1958 | Fed. Rep. of Germany | 5/419 |
| 1046514 | 12/1953 | France | 5/419 |
| 1047698 | 12/1953 | France | 5/419 |
| 1106026 | 12/1955 | France . | |
| 962694 | 1/1964 | United Kingdom | 5/419 |

OTHER PUBLICATIONS

"Special Water Mattresses" an ad on p. 24 of The Jul. 4, 1983 issue of the Waterbed Magazine.

*Primary Examiner*—Alexander Grosz
*Attorney, Agent, or Firm*—Schapp and Hatch

[57] ABSTRACT

A water-cooled louging pad having circular top and bottom sheets of flexible plastic material to be lain upon by a person obtaining a suntan, a heat seal joining the top and bottom sheets at their peripheries to form a flattened circular waterproof closure capable of retaining a body of water therein, and valve means in one of the sheets formed for slectively admitting a desired quantity of water into the enclosure and for retaining the body of water in the enclosure and for discharging desired quantities of water from the enclosure, the diameter of the pad is 7 feet 6 inches and it is 10 to 15 inches high at the center. The material is white ultraviolet-stablized vinyl sheet of 20 mil thickness substantially opaque to sunlight. The method provides a circular peripheral seal from a fixed work station by supporting the vinyl sheets on a table rotatable about a central axis.

5 Claims, 1 Drawing Sheet

WATER-COOLED LOUNGING PAD

BACKGROUND OF THE INVENTION

1. Field of the Invention

This invention relates to a lounge pad for suntanning, and more particularly to a lounge pad which is capable of cooling an occupant lying on the pad in the hot rays of the sun.

2. Description of the Prior Art

Lounge pads for suntanning are usually made of canvas or plastic-coated fabric stuffed with resiliently spongy material such as kapok, shredded foam rubber and the like. Other lounge pads are made of non-permeable sheet plastic and are inflated with air. Water is generally not used for inflating suntanning lounge pads because the water heats up when the pad is lying in the sun, and the pad becomes uncomfortably hot for lying upon.

Typical non-inflated flattened pads and cushions may be found in U.S. Pat. Nos. Des. 107,520; Des. 197,397; and Des. 255,854, together with German Pat. No. 864,314.

Typical air-inflated flattened pads, mattresses and pillows may be found in U.S. Pat. No. 3,416,169; and 4,629,433; U.S. Pat. No. Des. 253,983; U.S. Pat. No. Des. 278,004; British Pat. No. 962,694; French Pat. No. 1,046,514; French Pat. No. 1,047,698; French Pat. No. 1,106,026; and German Pat. No. DAS 1,034,337.

U.S. Pat. No. 4,459,714 shows a series of linked-together cushions, one form being intended for inflation with a mixture of water and air.

The above-listed patents are believed to be relevant to the present invention because they were adduced by a prior art search made by an independent searcher, and a copy of each of the above-listed patents is supplied to the Patent and Trademark Office herewith.

(The term "prior art" as used herein or in any statement made by or on behalf of applicant means only that any document or thing referred to as prior art bears, directly or inferentially, a date which is earlier than the effective date of this application.

No representation or admission is made that any of the above-listed documents is part of the prior art in any acceptation of that term, or that no more pertinent information exists.

SUMMARY OF THE INVENTION

The present invention provides a water-cooled lounging pad of a shape and size capable of entirely supporting the bodies of one or more persons in position for obtaining suntans by direct impingement of the sun's rays. The lounging pad of the present invention is circular and is of a diameter considerably larger than the length of the body and head of each of the anticipated users.

The lounging pad of the present invention is flattened so that the body of the user is raised only a few inches above the supporting surface on which the pad rests. This surface may consist of cement, wooden decking, sand, gravel, or any other reasonably flat and level surface capable of supporting the lounge pad. The pad, being filled with water, acts somewhat in the manner of a water mattress in comfortably supporting the body of the user or users, and the height of the body above the supporting surface can be regulated within limits by injecting further water or drawing off water through a valve means.

The lounging pad of the present invention may be left out in the sun indefinitely and still be comfortably cool to the body of the suntanner lying upon it. This coolness is accomplished by preventing excessive heating of the body of water contained within the pad. This prevention of excessive heating is accomplished by fabricating the pad from two circular sheets of plastic sealed together along their peripheral edges to form a flattened, circular waterproof enclosure capable of retaining a relatively large body of water therein to act as a heat sink.

The upper sheet is made of solar heat reflective flexible plastic material adapted to be lain upon by the person obtaining a suntan. The top sheet is of substantially white color for reflection of the sun's rays so as to avoid heating of the body of water contained within the pad. The top sheet is also substantially opaque to passage of sunlight therethrough so as further to avoid solar heating of the body of water.

The lower sheet may be heat transmissive for passage of heat from the water into the supporting surface. However, it is preferred to also make the bottom sheet resistant to passage of heat therethrough in order to prevent undue heating of the water if the pad is moved to a previously unoccupied location or is inverted. With the top and bottom sheets both made of white, opaque plastic material, the pad can be used with either side up. Both the top and bottom sheets are made of ultraviolet-stablized vinyl, preferably of approximately 20 mil thickness. The preferred size for the water-cooled pad is 7 foot 6 inches in diameter and 10 to 15 inches high at the center when inflated with water.

In fabricating the water-cooled pad of the present invention, the top and bottom plastic sheets are stacked upon a turntable which revolves about a vertical axis as the seal between the sheets is being made. This seal is accomplished by partial melting and bonding of the plastic sheets along their periphery by application of RF energy. The rotation of the table supporting the sheets makes it possible to accomplish the seal in overlapping increments along the edge of the pad in such manner as to leave no pin holes or other defects in the airtight integrity of the seals.

A peripheral, slightly upstanding, thin metal band melts part way through the top and bottom sheets to provide a "tear strip" or thin area by which the unwanted portions of the sheets can easily be separated from the pad and removed.

It is therefore a principal object of the present invention to provide a lounging pad for suntanning which is water-cooled for comfort of the user, and in which the sun's rays are prevented from unduly heating the water cooling the pad.

Another object of the present invention is to provide a water-cooled lounging pad of the character described in which a body of cooling water is enclosed within the pad, and the upper portion of the pad is of substantially white color for reflection of the sun's rays and is also substantially opaque to passage of sunlight therethrough so as further to avoid solar heating of the body of water within the pad.

A further object of the present invention is to provide a method of forming a water-cooled lounging pad of the character set forth in which stacked sheets of vinyl material are heat sealed together in a circular ring defining the outer edge of the lounging pad, a segment of the ring being heat-sealed at a fixed station and the stacked top and bottom sheets being rotated about an axis normal to the planes of the sheets in increments corresponding to the angular displacement of the heat sealed segments to provide a continuous air and water proof seal between the top and bottom sheets.

Other objects and features of advantage will become apparent as the specification progresses and from the claims.

Figure 1:
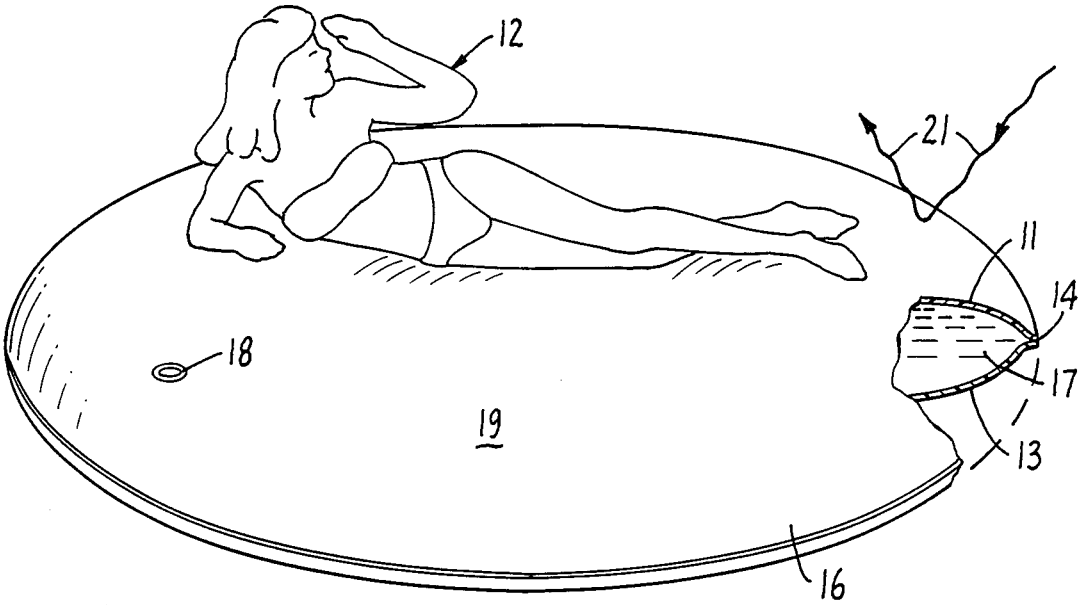
FIG. 1 is a perspective view of a water-cooled lounging pad constructed in accordance with the present invention and carrying a sunbather on its upper surface, a portion of the lounging pad being broken away and shown in section to illustrated internal construction.
Figure 2:
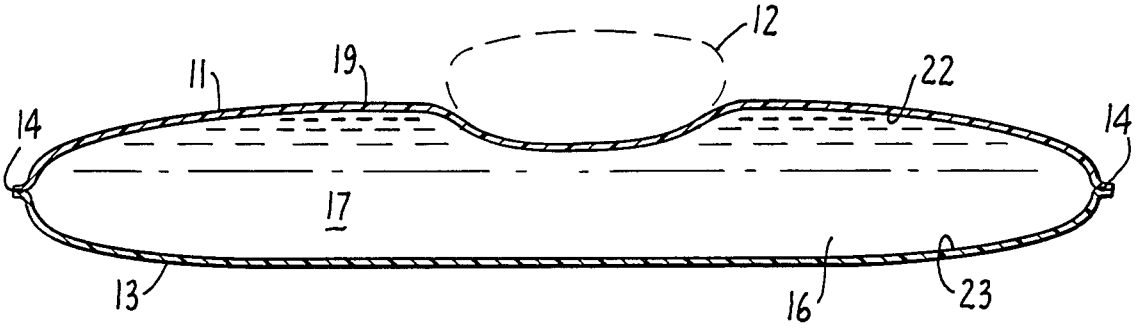
FIG. 2 is a vertical cross-sectional view taken on a vertical plane coinciding with the vertical central axis of the pad.

While only the preferred form of the invention is illustrated in the drawings, it will be apparent that various modifications could be made without departing from the ambit of the claims.

DESCRIPTION OF THE PREFERRED EMBODIMENT

As may be seen in the accompanying drawings, the water-cooled lounging pad of the present invention provides a circular top sheet 11 of solar heat reflective flexible plastic material adapted to be lain upon by a person 12 obtaining a suntan, a circular bottom sheet 13 of flexible plastic material substantially coextensive with the top sheet 11, a heat seal 14 joining the top and bottom sheets 11 and 13 at their peripheries to form a flattened circular waterproof enclosure 16 is capable of retaining a body of water 17 therein and valve means 18 in one of the sheets 11, 13 formed for selectively admitting a desired of water into the enclosure 16 and for retaining the body of water 17 in the enclosure 16 and for discharging desired quantities of water from the enclosure 16 so as to vary the height and support characteristics of the lounging pad 19.

In accordance with the present invention, the top sheet 11 is of substantially white color for reflection of the sun's rays 21 so as to avoid solar heating of the body of water 17 whereby the body of water exerts a cooling effect on the portions of the body of the person 12 which are in contact therewith. The top sheet 11 also is substantially opaque to passage of sunlight therethrough so as further avoidance of solar heating of the body of water 17.

The bottom sheet 13 may be of any suitable flexible sheet material capable of being heat sealed to the top sheet. Preferably, the bottom sheet 13 is also of substantially white color and substantially opaque to passage of sunlight there through so that inversion of the water-cooled lounging pad 19 still provides a water-cooled upper lounging surface.

Figure 4:
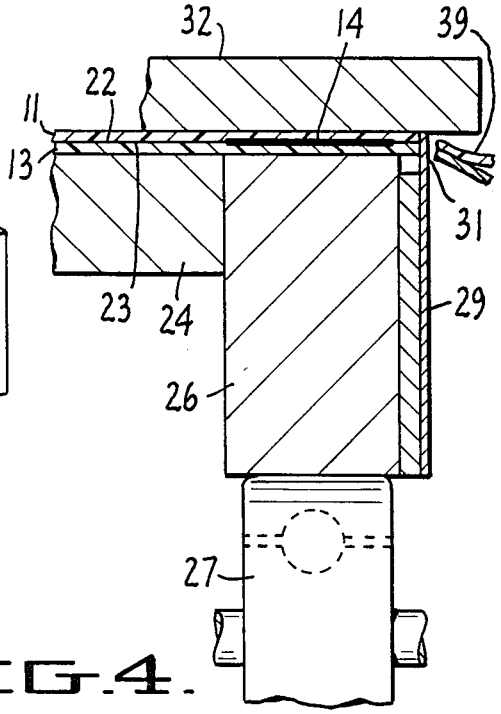
FIG. 4 is an enlarged cross-sectional view taken substantially on the plane of Line 4—4 of FIG. 3, but showing the heat seal electrodes in the act of accomplishing a continuous heat seal between the vinyl sheets along their respective edges.

As may best be seen in FIG. 4 of the drawings, the heat seal 14 is provided at the confronting faces 22 and 23 of the circular top and bottom sheets 11 and 13 at their mutual peripheries. In the preferred form of the invention, the flexible plastic material of both the top sheet 11 and bottom sheet 13 comprises ultraviolet-stablized vinyl capable of resisting deterioration from the ultraviolet in the rays 21 of the sun over a comparatively long period of time, say, two years to four years, depending upon exposure conditions.

The described construction of the water-cooled lounging pad 19 of the present invention permits the pad to have a diameter considerably longer than the length of the body or bodies of the suntanner or suntanners using the lounging pad so that feet and other body parts will not hang over the edge. Also, when made in the preferred size of 7 feet 6 inches diameter, more than one suntanner can be supported in comfort on the pad at the same time. The pad 19 is preferably 10 to 15 inches high at the center when inflated, and this height and the firmness of the support can be varied by adding to or taking away from the body of water 17 contained within the pad. The described construction also equalizes and spreads stresses throughout the pad to resist tearing of the material of the sheets. It has been found that a "butt" or face to face weld 14, of the character illustrated in FIG. 4 of the drawings, is considerably stronger than other types of weld and is much more resistent to tearing.

In accordance with the present invention, a novel method and apparatus is provided for sealing and shaping the lounging pad 19. Rectangular (or other shape) sheets 11 and 13 are stacked on a flat circular table top 24, the sheets 11 and 13 being of larger extent than the diameter of table top 24. The edge 26 of the table top 24 consists of a circular ring supported for rotation upon a series of rollers 27 carried by a supporting structure 28. Table top 24 and its peripheral ring 26 are rotatable about a vertical central axis.

A band 29 extends all the way around the outer periphery of the table top 24 and ring 26, and has a portion 31 protruding upwardly approximately 18/1000ths of an inch above the ring 26, which provides a main sealing bar. A second sealing bar 32 is positioned in normally spaced relation above a portion of the main sealing bar 26 and is vertically reciprocable between the positions illustrated in FIG. 3 and FIG. 4. When the sealing bar 32 decends into proximity with sealing bar 26 to clamp the sheets 11 and 13 therebetween, the portion 31 of band 29 pinches and thins the material of the sheets to provide a peripheral "tear seal". This makes it easy for the operator to tear away the unwanted portions of the sheets 11 and 13 outside the periphery of the heat seal 14.

Figure 3:
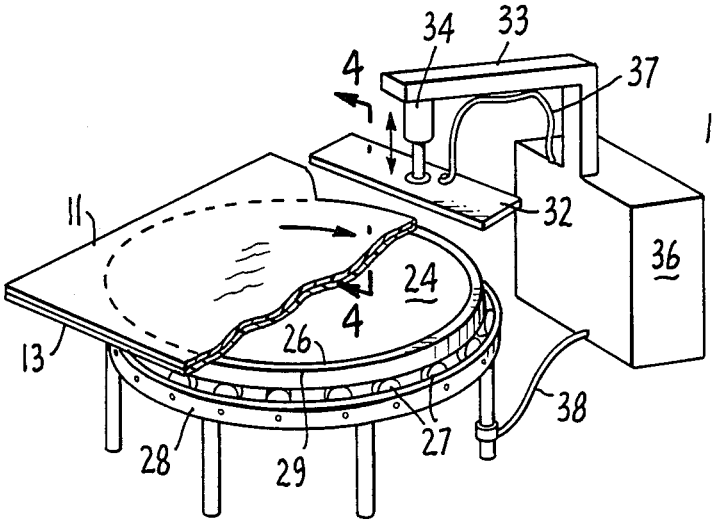
FIG. 3 is a schematic view of an apparatus used for fabricating a circular ring shaped heat seal between stacked sheets of vinyl, with portions of the vinyl sheets being broken away for better illustration.

In accordance with the present invention, the sealing bar 32 is supported on an overhanging arm 33 through a vertically expandable pneumatic cylinder 34 capable of selectively lifting the sealing bar 32 to the position illustrated in FIG. 3 of the drawings and urging it downwardly to the position illustrated in FIG. 4 of the drawings.

The actual heat sealing is accomplished by applying RF frequencies between the bars 32 and 26 to form the heat seal 14 (see FIG. 4 of the drawings). The RF source is conventional and is contained within a housing 36, with leads 37 connected to bar 32 and structure 28 in the manner illustrated in FIG. 3 of the drawings.

In operation, the sheets 11 and 13 are stacked upon table 24. The bar 32 is lowered to the position of FIG. 4 while RF current is applied, thus forming the heat seal 14 along a segment of the periphery of the top and bottom sheets 11 and 13 within the tear strip 39.

The bar 32 is then raised and the table 24 is rotated by an increment equivalent to the length of the heat seal weld. The bar 32 is then lowered again to the position of FIG. 4 and RF energy is applied to accomplish the next segment of the heat seal 14. This continues, with the sheets being rotated about the vertical axis of the table 24 in a step and repeat manner until the desired non-permeable heat seal 14 has been formed in a continuous ring around the periphery of the now circular sheets.

From the foregoing, it will be seen that the water-cooled lounging pad of the present invention provides a novel means for supporting one or more sunbathers in water cooled comfort upon the pad, and the described method and apparatus facilitates the fabrication of the described structures.

What is claimed is:

1. A water-cooled lounging pad, comprising a circular top sheet of solar heat reflective flexible plastic material adapted to be lain upon by a person obtaining a suntan, a circular bottom sheet of flexible plastic material substantially coextensive with said top sheet, a heat seal joining said top and bottom sheets at their peripheries to form a flattened circular waterproof enclosure capable of retaining a body of water therein, and valve means in one of said sheets formed for selectively admitting a desired quantity of water into said enclosure and for retaining said body of water in said enclosure and for retaining said body of water in said enclosure and for discharging desired quantities of water from said enclosure, said top sheet being of substantially white color for reflection of the sun's rays so as to avoid solar heating of said body of water whereby said body of water exerts a cooling effect on the portions of the body of said person in contact with said top sheet.

2. A water-cooled lounging pad as described in claim 1, and wherein said top sheet also is substantially opaque to passage of sunlight therethrough so as further to avoid solar heating of said body of water.

3. A water-cooled lounging pad as described in claim 2, and wherein said bottom sheet is also of substantially white color and substantially opaque to passage of sunlight therethrough whereby inversion of said water-cooled lounging pad also provides a water-cooled upper lounging surface.

4. A water-cooled lounging pad as described in claim 1 and wherein said heat seal is provided at confronting faces of said circular top and bottom sheets at their peripheries.

5. A water-cooled lounging pad as described in claim 1, and wherein said flexible plastic material of said top sheet comprises ultraviolet-stabilized vinyl.

* * * * *